US010854067B1

(12) United States Patent
Giles

(10) Patent No.: US 10,854,067 B1
(45) Date of Patent: Dec. 1, 2020

(54) CONNECTED DOOR HINGE

(71) Applicant: Alarm.com Incorporated, Tysons, VA (US)

(72) Inventor: Chad Giles, St. Paul, MN (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

(21) Appl. No.: 16/448,344

(22) Filed: Jun. 21, 2019

Related U.S. Application Data

(63) Continuation of application No. 15/978,665, filed on May 14, 2018, now Pat. No. 10,332,383.

(60) Provisional application No. 62/505,191, filed on May 12, 2017.

(51) Int. Cl.

| | |
|---|---|
| ***G08B 25/00*** | (2006.01) |
| ***G08B 21/14*** | (2006.01) |
| ***G08B 7/06*** | (2006.01) |
| ***G08B 13/08*** | (2006.01) |

(52) U.S. Cl.
CPC ..... *G08B 25/008* (2013.01); *G08B 7/06* (2013.01); *G08B 13/08* (2013.01); *G08B 21/14* (2013.01)

(58) Field of Classification Search
None
See application file for complete search history.

(56) References Cited

U.S. PATENT DOCUMENTS

| | | | | |
|---|---|---|---|---|
| 4,334,388 | A * | 6/1982 | Kambic | G08B 13/08 49/13 |
| 6,737,969 | B2 | 5/2004 | Carlson et al. | |
| 10,204,466 | B1 * | 2/2019 | Rothmuller | G07C 9/00309 |
| 10,332,383 | B1 * | 6/2019 | Giles | G08B 21/24 |
| 10,360,746 | B1 * | 7/2019 | Giles | G08B 25/008 |
| 10,613,519 | B2 * | 4/2020 | Herthan | E05F 15/73 |
| 10,636,283 | B2 * | 4/2020 | Trundle | G08B 29/02 |
| 10,636,284 | B1 * | 4/2020 | Trundle | G08B 25/08 |
| 10,638,096 | B1 * | 4/2020 | Lin | G08B 13/19656 |
| 2002/0154012 | A1 * | 10/2002 | Risi | E05G 5/003 340/541 |
| 2005/0193632 | A1 | 9/2005 | Orban et al. | |
| 2006/0031671 | A1 * | 2/2006 | Schmit | G08B 25/10 713/160 |
| 2009/0145031 | A1 * | 6/2009 | Collene | E05F 17/004 49/113 |
| 2010/0050524 | A1 * | 3/2010 | Helms | E05F 15/622 49/26 |

(Continued)

FOREIGN PATENT DOCUMENTS

DE 102004017341 B4 8/2012

*Primary Examiner* — Fekadeselassie Girma
(74) *Attorney, Agent, or Firm* — Fish & Richardson P.C.

(57) ABSTRACT

A computer-implemented method includes receiving a disarm code, comparing, the received disarm code to a stored disarm code, determining that the received disarm code matches the stored disarm code, determining a property access pattern that corresponds to the stored disarm code, that identifies a first group of doors at the property that should be opened, and that identifies a second group of doors at the property that should be closed, providing to each door hinge device on a respective door of the first group, a first instruction to open, providing to each door hinge device on each of the doors of the second group, a second instruction to close, and disarming the monitoring system.

18 Claims, 7 Drawing Sheets

| | Code / Armed Status | | | |
|---|---|---|---|---|
| Door hinge | 2468 | 1357 | Arm Stay | Arm away |
| Master bedroom | open | close | open | close |
| Kid bedroom | close | close | open | close |
| Basement | open | open | closed | close |
| Garage | open | open | closed | close |

| | |
|---|---|
| Master bedroom | open |
| Kid bedroom | close |
| Basement | open |
| Garage | open |

(56) References Cited

U.S. PATENT DOCUMENTS

| | | | | |
|---|---|---|---|---|
| 2010/0264688 | A1* | 10/2010 | Cheal | E05F 15/655 296/146.4 |
| 2012/0153783 | A1* | 6/2012 | Shoenfeld | A61L 2/10 312/209 |
| 2014/0069408 | A1* | 3/2014 | Yantis | F24C 15/023 126/190 |
| 2014/0208651 | A1* | 7/2014 | Wolfe | E05B 65/08 49/24 |
| 2016/0187368 | A1* | 6/2016 | Modi | G01P 15/00 702/141 |
| 2016/0284142 | A1* | 9/2016 | Elbling | G07C 9/25 |
| 2016/0376826 | A1* | 12/2016 | Wu | E05F 15/70 340/547 |
| 2017/0372555 | A1* | 12/2017 | Clark | G07F 11/62 |
| 2018/0079620 | A1* | 3/2018 | Schroeder-Brumloop | B66B 13/146 |
| 2018/0116415 | A1* | 5/2018 | Karschnik | A61B 5/4809 |
| 2018/0223583 | A1* | 8/2018 | Podkopayev | F16D 3/207 |
| 2018/0258598 | A1* | 9/2018 | Kramer | E01F 13/08 |
| 2019/0024437 | A1* | 1/2019 | Tagtow | E05F 15/77 |
| 2019/0033856 | A1* | 1/2019 | Ferguson | G06N 20/00 |
| 2019/0210459 | A1* | 7/2019 | Kojima | B60W 20/00 |
| 2019/0218068 | A1* | 7/2019 | Seki | B66B 13/146 |

* cited by examiner

CONNECTED DOOR HINGE

CROSS REFERENCE TO RELATED APPLICATIONS

This application is a continuation of U.S. application Ser. No. 15/978,665, filed May 14, 2018, now allowed, which claims the benefit of U.S. Provisional Application No. 62/505,191, filed May 12, 2017, and titled "Connected Door hinge." Both of these prior applications are incorporated by reference in their entirety.

TECHNICAL FIELD

This disclosure relates to property monitoring technology and, for example, controlling access to rooms within a property by integrating connected door hinges into a property monitoring system.

BACKGROUND

Many people equip homes and businesses with monitoring systems to provide increased security for their homes and businesses.

SUMMARY

Techniques are described for monitoring technology. For example, techniques are described for integrating connected door hinges into a monitoring system to control the access to rooms within a property.

According to an innovative aspect of the subject matter described in this application, a monitoring system that is configured to monitor a property, the monitoring system includes a monitor control unit that is configured to receive user input, and one or more door hinges that are located on doors at the property and that are each configured to open and close a respective door in response to instructions from a monitor control unit, where the monitor control unit is configured to receive a disarm code, compare the received disarm code to a stored disarm code, based on comparing the received disarm code to the stored disarm code, determine that the received disarm code matches the stored disarm code, based on determining that the received disarm code matches the stored disarm code, determine a property access pattern that corresponds to the stored disarm code, that identifies a first group of the doors at the property that should be opened, and that identifies a second group of the doors at the property that should be closed, provide, to each door hinge on a respective door of the first group, a first instruction to open, provide, to each door hinge on a respective door of the second group, a second instruction to close, and based on providing, to each door hinge on the respective door of the first group, the first instruction to open, and providing, to each door hinge on the respective door of the second group, the second instruction to close, disarm the monitoring system.

These and other implementations each optionally include one or more of the following optional features. The monitor control unit is configured to determine that the received disarm code matches the stored disarm code by determining that the received disarm code matches the stored disarm code that is among multiple disarm codes, and where each of the multiple disarm codes corresponds to a different property access pattern. The monitor control unit is configured to receive a request to arm the monitoring system in armed stay mode, based on the request to arm the monitoring system in the armed stay mode, determine a second property access pattern that corresponds to the armed stay mode, that identifies a third group of the doors at the property that should be opened, and that identifies a fourth group of the doors at the property that should be closed, provide, to each door hinge on a respective door of the third group, a third instruction to open, and provide, to each door hinge on a respective door of the fourth group, a fourth instruction to close, and based on providing, to each door hinge on the respective doors of the third group, the third instruction to open and providing, to each door hinge on a respective doors of the fourth group, the fourth instruction to close, arm the monitoring system in armed stay mode.

The monitor control unit is further configured to receive a request to arm the monitoring system in armed away mode, based on the request to arm the monitoring system in the armed away mode, determine a third property access pattern that corresponds to the armed away mode, that identifies a fifth group of the doors at the property that should be opened, and that identifies a sixth group of the doors at the property that should be closed, provide, to each door hinge on a respective door of the fifth group, a fifth instruction to open, provide, to each door hinge on a respective door of the sixth group, a sixth instruction to close, and based on providing, to each door hinge on the respective doors of the fifth group, a fifth instruction to open and providing, to each door hinge on the respective doors of the sixth group, a sixth instruction to close, arm the monitoring system in armed away mode.

The monitoring system includes one or more sensors that are located at the property and that are configured to provide sensor data to the monitor control unit, where the monitor control unit is further configured to analyze the sensor data, based on analyzing the sensor data, determine a second access pattern that identifies a third group of doors at the property that should be opened and a fourth group of doors at the property that should be closed, provide, to each door hinge on a respective door of the third group, a third instruction to open, and provide, to each door hinge on a respective door of the fourth group, a fourth instruction to close. The monitoring system includes one or more sensors comprise one or more contact sensors that are configured to provide contact sensor data to the monitor control unit, and the monitor control unit is further configured to analyze the sensor data by determining that the contact sensor data indicates an emergency event, determining the type of emergency event, and determining a room where the emergency event occurred, and based on determining the emergency event is a breached contact sensor emergency event, the second access pattern identifies a third group of doors at the property that should be opened to include each of the doors at the property except a door to the room of the property where the breached contact sensor emergency event occurred, and the fourth group of doors that should be closed to include the door to the room of the property where the emergency event occurred.

The monitor control unit is configured to provide, to the door hinge on the door to the room of the property where the breached contact sensor emergency event occurred, an instruction to activate an LED on the door hinge. The one or more sensors included in the monitoring system include one or more motion sensors that are configured to provide motion sensor data to the monitor control unit, and one or more carbon monoxide sensors that are configured to provide carbon monoxide sensor data to the monitor control unit. The monitor control unit is configured to receive, from a carbon monoxide sensor of the one or more carbon monoxide sensors, carbon monoxide sensor data indicating that a carbon monoxide level in a room with the carbon monoxide sensor exceeds a threshold, receive motion sensor data from a motion sensor of the one or more motion sensors located in the room with the carbon monoxide sensor, analyze the motion sensor data to determine an occupancy for the room with the carbon monoxide sensor, based on determining the occupancy for the room with the carbon monoxide sensor, provide, to the door hinge on the door to the room with the carbon monoxide sensor, an instruction to output a voice command instructing occupants of the room with the carbon monoxide sensor to vacate, based on providing, to the door hinge on the door to the room with the carbon monoxide sensor, an instruction to output a voice command instructing occupants of the room with the carbon monoxide sensor to vacate, provide, an instruction to the motion sensor in the room with the carbon monoxide sensor to motion sensor data, analyze the motion sensor data to determine that the room with the carbon monoxide is vacant, and based on determining that the room with the carbon monoxide sensor is vacant, provide, to the door hinge on the door to the room with the carbon monoxide sensor, an instruction to close.

The monitoring system further comprising one or more cameras that are located at the property and that are configured to provide image data to the monitor control unit, where the monitor control unit is configured to provide an instruction to a camera of the one or more cameras in the room with the carbon monoxide sensor to begin to capture image data, and analyze the image data to confirm the room with the carbon monoxide sensor is vacant. The monitoring system further includes one or more cameras that are located at the property and that are configured to provide image data to the monitor control unit, where the one or more sensors include one or more motion sensors that are located at the property and that are configured to provide motion sensor data to the monitor control unit, and where the monitor control unit is configured to receive, from a contact sensor of the one or more contact sensors, additional contact sensor data indicating that a window in a room with the contact sensor is breached, receive motion sensor data from a motion sensor of the one or more motion sensors located in the room with the contact sensor, analyze the motion sensor data to determine occupancy data for the room with the contact sensor, based on receiving determining occupancy data from a motion sensor located in the room with the contact sensor, provide, to the one or more cameras located in the room with the contact sensor, an instruction to capture image data, analyze the image data to determine that an occupant of the room with the contact sensor is an unknown person, and based on determining that the occupant of the room with the contact sensor is an unknown person, provide to the door hinge on the door to the room with the contact sensor, an instruction to close.

The monitor control unit is further configured to receive from a door hinge on a door in the first group or from a door hinge on a door in the second group, data indicating that the door hinge on the door in the first group is unable to open or the door hinge on the door in the second group is unable to close, generate a notification that indicates that the door hinge on the door in the first group is unable to open or that the door hinge on the door in the second group is unable to close, and provide, for output, the notification. The monitor control unit is configured to receive, from a user, a timing schedule that identifies a time range for the property access pattern, compare a current time to the time range for the property access pattern, determine that the current time is within the time range for the property access pattern, and provide the first instruction to open and the second instruction to close based on determining that the current time is within the time range for the property access pattern. The monitor control unit is configured to determine a door hinge on a door of the first group is open for a threshold period of time, and provide, to the door hinge on the door of the first group, an instruction to close, based on determining the door hinge on the door of the first group is open for the threshold period of time.

Implementations of the described techniques may include hardware, a method or process implemented at least partially in hardware, or a computer-readable storage medium encoded with executable instructions that, when executed by a processor, perform operations.

The details of one or more implementations are set forth in the accompanying drawings and the description below. Other features will be apparent from the description and drawings, and from the claims.

DETAILED DESCRIPTION

Techniques are described for integrating door hinges into a monitoring system to control the access to rooms within a property. A property may be equipped with one or more doors that each include connected door hinges. The connected door hinges may be configured to retrofit to any indoor or outdoor door. A user may control the opening and closing of the hinges fitted to the doors through a native application on a user device. The one or more connected door hinges may be integrated into a monitoring system at the property, and the user may set specific open/close patterns for each of the door hinges within the property based on timing schedules and disarm codes used for the in-home security system. A control unit that controls the monitoring system at the property may store the user specified door hinge open/close pattern, and may communicate commands to open and/or close each of the one or more door hinges at the property based on the specified open/close pattern. For example, the control unit may command the door of the master bedroom to close and lock, and the door of the garage to close and lock when the user arms the security system.

Figure 1:
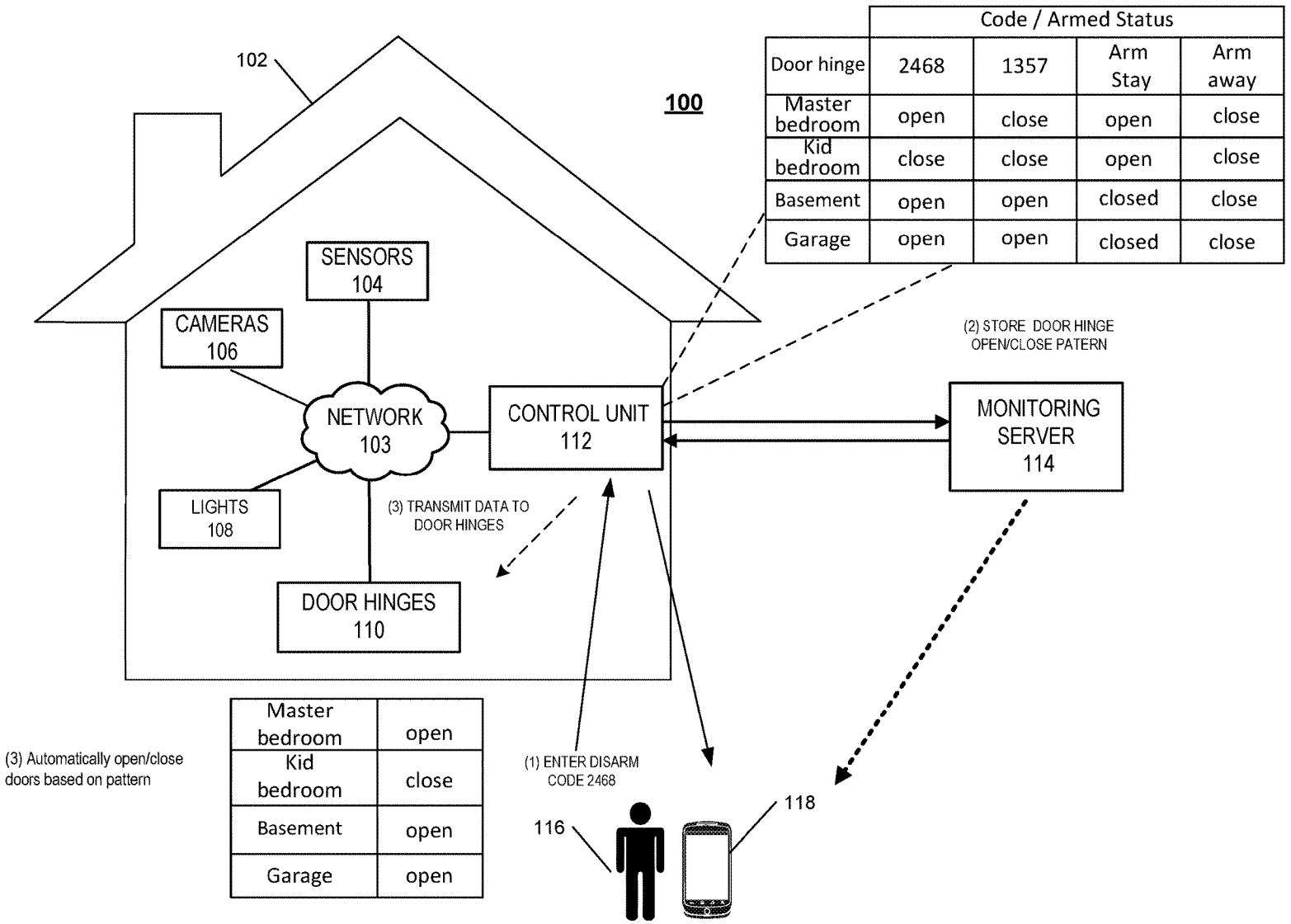
FIG. 1 illustrates an example of a system for controlling access in a property.

FIG. 1 illustrates an example of a monitoring system 100 integrated with one or more connected door hinges 110. As shown in FIG. 1, a property 102 (e.g., a home) of a user 116 is monitored by an in-home monitoring system (e.g., in-home security system) that includes components that are fixed within the property 102. The in-home monitoring system may include a control unit 112, one or more sensors 104, one or more cameras 106, one or more lights 108, and one or more door hinges 110. The in-home monitoring system may also include other connected devices, for example, a thermostat, garage doors, door knobs, doorbells, smart televisions, entertainment devices, or any other suitable connected device. The in-home monitoring system may be integrated with one or more door hinges 110 that are fitted unto the doors, and control the opening and closing of the doors. The door hinge may also control the locking and unlocking of the door to which it is fitted. In some examples, the door hinge may be fitted to an indoor door, and in some examples the door hinge may be fitted to an outdoor door. For example, a connected door hinge may be fitted to the door of the garage or bathroom.

The connected door hinge may look similar to a typical door hinge. The door hinge may include a frame side plate and a door side plate that are each the same size and shape of the plates of a standard door hinge plate. In some implementations, the door hinge may include a motor and a telescopic rod that is attached to the door side plate of the hinge, and that extends across to the frame side plate of the door hinge. The telescopic rod may expand and contract to open and close the door hinge. In other examples, the door hinge may include a motor and a slotted pin. The motor may move and cause the slotted pin to open and close the door hinge. The connected door hinge may include a wireless communicator and a small battery that powers the door hinge. The battery and the wireless communicator may be located inside a drawer on the frame side plate of the hinge. The connected door hinge may include a status LED at the top of the pin of the hinge. In some implementations, the size and shape of the connected door hinge may differ from the standard door hinge.

In the example shown in FIG. 1, the user 116 may enter a disarm code into the control unit 112. The control unit 112 may include a user interface that allows the user to arm and disarm the in-home monitoring system. When the user 116 enters an authentic disarm code into the control unit 112, the control unit 112 disarms the in-home monitoring system, and automatically opens or closes one or more doors fitted with connected door hinges within the monitored property 102 based on a door hinge open/close pattern associated with the entered code. The disarm code entered by a user is a user specific PIN code that is associated with instructions for which of the one or more doors fitted with connected door hinges should be opened, and which should be closed when the particular code is entered. When the door is closed, the connected door hinge may lock the door, or may also unlock the door when the door originally is in a locked position. The door hinge may include a strike plate that is similar in size and shape to a traditional strike plate. The strike plate may include a motor and a mechanical telescopic latch rod that is used to lock and or unlock the door when the door is in a closed position. In some examples, the strike plate may not be similar in size and shape to a traditional strike plate. The mechanical latch rod is retracted to unlock the door and allow the door hinge to open the door. For the example illustrated in FIG. 1, when the user enters the disarm code 2468, the instructions to open the door to each of the master bedroom, the basement and the garage by the door hinges, and to close the door to kid bedroom by the door hinges.

A user 116 associated with the monitored property 102 may configure the door hinge open/close pattern for each of a one or more disarm codes. The user 116 may configure the system by logging into a website supported by the monitoring system, or by accessing an application that is hosted on a mobile device. The user 116 may assign a specific code for each of the members of the family associated with the monitored property 102, and may assign the door hinge open/close pattern based on the preferred level of access for each of the family members. For example, the father may be assigned a disarm code that is associated with one particular door hinge open/close pattern, and the mother may be assigned a different disarm code that is associated with a different door hinge open/close pattern. In some examples, each of the family members associated with the property may use a single disarm code and therefore have the same level of access when the in-home security system is disarmed.

The user 116 associated with the monitored property 102 may configure the system with one or more disarm codes for visitors to the property 102. The user 116 may assign disarm codes that allow different visitors to have different levels of access to the rooms of the property 102 based on the door hinge open/close pattern associated with the assigned disarm code. For example, the user 116 may assign a disarm code for a dog walker and assign the door hinge open/close pattern based on the disarm code. The code assigned to the dog walker only unlocks and opens the door hinges on the doors that are used to access the dog and the leash. For example, the code may unlock and open the door hinges to the doors to the main living area, and close and lock all the other door hinges within the property. In another example, the user 116 may assign a disarm code for a technician or contractor that is scheduled to visit the property when the user is not present, and may assign the door hinge open/close pattern based on the disarm code. The code assigned to the technician or contractor opens and unlocks the door hinges on doors that lead to the rooms that the contractor would need to access to complete the task. For example, a plumber may be scheduled to fix a leak in a bathroom in the upper level of the monitored property. The code assigned to the plumber may open and unlock the connected door hinges to the doors along a path to the bathroom and close and lock all the other doors with connected door hinges at the property. In some implementations, the door hinges may be configured to unlock and open doors, and close and lock doors.

The user 116 associated with the monitored property 102 may configure the access level to rooms within the property based on a current arming status of the in-home monitoring system. The user 116 may configure different door hinge open/close patterns based on whether the in-home system is in arm away mode or arm stay mode. For example, when the in-home monitoring system is armed away, the user may configure all the connected door hinges to close all the doors within the property. In some examples, the user may configure the in-home monitoring system to prompt the connected door hinge on the door of a room to close and lock based on a detected alarm condition. For example, a contact sensor on the window of the guest bedroom may detect a break in, the sensor may communicate this data to the control unit at the property which in turn would communicate with the connected door hinge on the door to the guest room instructing the hinge to close and lock the door. By closing and locking the door to the room that the burglar broke into, the burglar is restricted to one room. The LED on the door hinge may flash red when the alarm throughout the monitored property sounds when the break in is detected by the window sensor.

The connected door hinge open/close patterns which control access to rooms within the monitored property 102 may be set by the user 116 associated with the property based on the user's preferences. In some implementations, the connected door hinge open/close patterns may be received from a monitoring server 114. The monitoring server 114 is a remote server that communicates with one or more other in-home monitoring systems. The monitoring server 114 may receive data from the one or more other in-home monitoring systems and determine the connected door hinge open/close patterns based on the received data. For example, the monitoring server 114 may receive data reporting several burglaries within the past hour in a local area of the monitored property 102. The monitoring server 114 may communicate to the control unit 112 at the monitored property 102 to close and lock all doors, based on determining that the in-home monitoring system at the property was armed away, and only a subset of the door knobs were configured to be closed by the user in this armed state. The monitoring server 114 may send a notification to the mobile device 118 of the user 116 to notify the user of the updated connected door hinge open/close pattern and the reason for the update.

The monitoring system may be configured to open or close one or more doors with connected door hinges based on detected alarm conditions. The control unit 112 at the monitored property may instruct specific doors to open and close, and instruct specific doors to lock or unlock based on the location of the detected alarm condition, and the type of alarm condition. For example, if a burglar broke into the window of a particular room of the property while the system was armed and motion sensor data determines that no one is in the room, the connected door hinge on the door to the particular room would immediately close and lock the door in an attempt to limit the burglar movements through the property. In another example, when the motion sensor data determines that a person is in the room with a broken window, the control unit instructs the connected door hinge to output an audio command instruction the person to vacate the room. The control unit 112 may then instruct the connected door hinge on the door to the room with the broken window to close and lock when the control unit receives data confirming the person vacated the room. The status indicator LED on the connected door hinge of the door to the particular room may flash to indicate an alarm situation. Closing and locking the door to the room where an alarm was triggered due to burglary may deter the burglar from breaking down an additional barrier to enter the property, and the flashing LED light may further deter the burglary. In another example, a carbon monoxide detector in a particular room may detect unsafe carbon monoxide levels. The control unit 112 at the monitored property may receive the sensor data from the carbon monoxide detector, and motion sensor data indicating that no one is in the room with the unsafe carbon monoxide levels, and communicates to the connected door hinge to close the door to the particular room to attempt to contain the threat of the carbon monoxide. In this example, the control unit 112 may also command one or more other door hinges at the monitored property 102 which provide an exit route for a person within the property to exit. For example, the control unit may command the door hinges to all bedrooms to close and lock, and may command the door hinges to the garage and front door to unlock and open to provide an exit to the person(s) within the property 102.

In some examples, the property 102 may not be monitored by an in-home monitoring system. In such examples, the user may open and close door hinges through the use of a connected door hinge application. Each of the one or more doors with connected door hinges may be identified in the application, and the user may have the ability to switch the door from open to close and from close to open.

In some implementations, the one or more connected door hinges 110 may include a speaker. The speaker may be configured to allow a user to perform two-way communication with connected hinges in other rooms of the property. The speaker may be configured to initiate two-way communication voice activated devices such as, the Amazon Alexa devices (Echo, Dot, Tap, Look, Show, etc.), Google Home, Apple TV, Fire TV and any other appropriate voice activated device.

In some implementations, the one or more connected door hinges 110 may include an integrated camera. The camera integrated into the connected door hinge may have a wide angle, and may configured to allow video chatting with other connected door hinges within the property. In some examples, the connected door hinge may be integrated with two cameras that allows the user to receive a real-time view of each side of the door with the connected door hinge. The camera may be configured to automatically detect when the person to the speaker in the connected hinge moved into a different room. The camera and speaker functionality would switch over automatically to the nearest connected hinge. For example, a user may call a second user through the monitoring application, and the second user may use voice activation to accept the call. As the second user moves through the property, the camera and speaker functionality may automatically switch to the connected hinge nearest to the second user.

Figure 2:
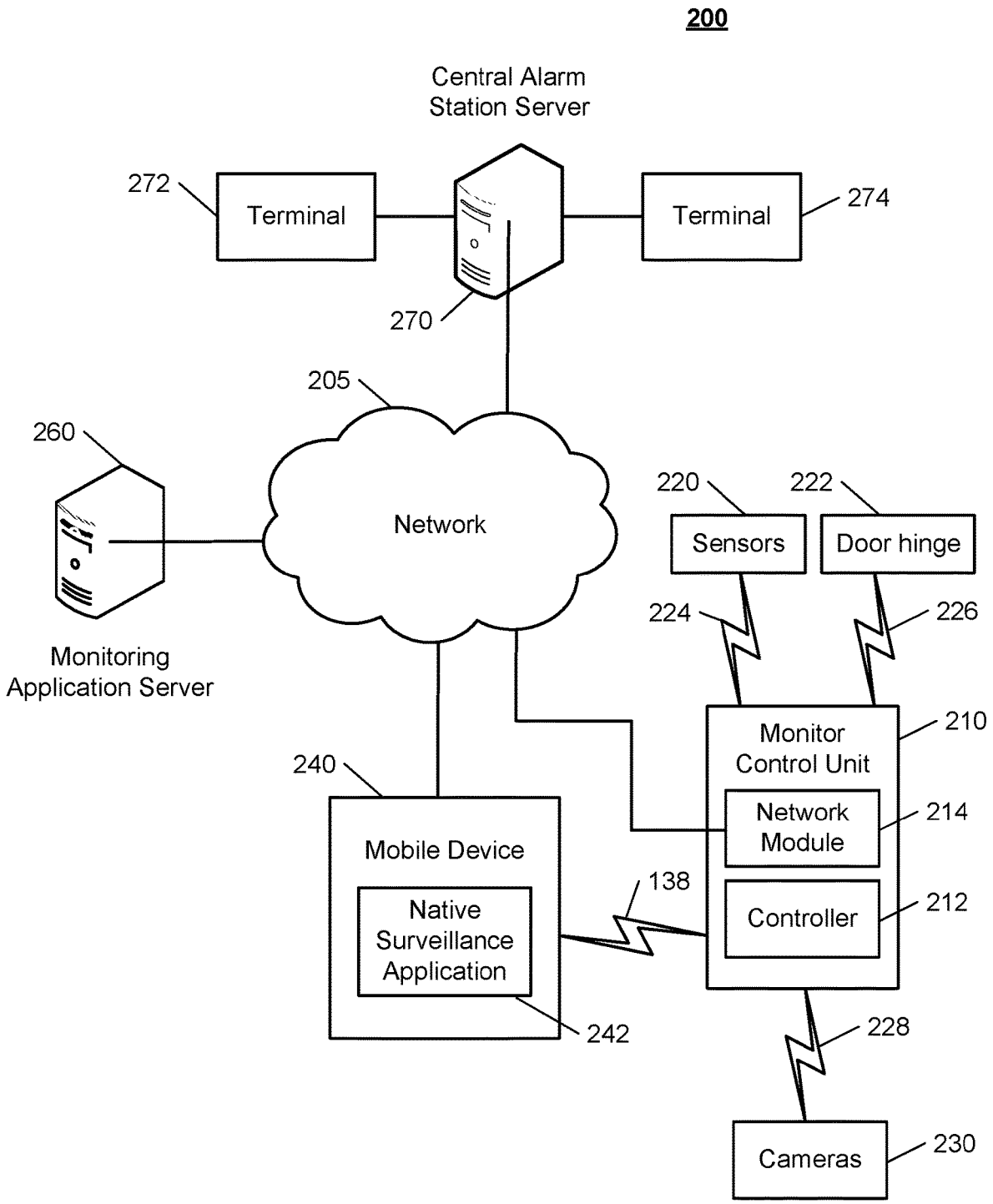
FIG. 2 illustrates an example of a monitoring system integrated with connected door hinges.

FIG. 2 illustrates an example of a system 200 configured to monitor a property. The system 200 includes a network 205, a monitoring system control unit 210, one or more user devices 240, a monitoring application server 260, and a central alarm station server 270. The network 205 facilitates communications between the monitoring system control unit 210, the one or more user devices 240, the monitoring application server 260, and the central alarm station server 270. The network 205 is configured to enable exchange of electronic communications between devices connected to the network 205. For example, the network 205 may be configured to enable exchange of electronic communications between the monitoring system control unit 210, the one or more user devices 240, the monitoring application server 260, and the central alarm station server 270. The network 205 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 205 may include multiple networks or subnetworks, each of which may include, for example, a wired or wireless data pathway. The network 205 may include a circuit-switched network, a packet-switched data network, or any other network able to carry electronic communications (e.g., data or voice communications). For example, the network 205 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 205 may include one or more networks that include wireless data channels and wireless voice channels. The network 205 may be a wireless network, a broadband network, or a combination of networks including a wireless network and a broadband network.

The monitoring system control unit 210 includes a controller 212 and a network module 214. The controller 212 is configured to control a monitoring system (e.g., a home alarm or security system) that includes the monitor control unit 210. In some examples, the controller 212 may include a processor or other control circuitry configured to execute instructions of a program that controls operation of an alarm system. In these examples, the controller 212 may be configured to receive input from indoor door knobs, sensors, detectors, or other devices included in the alarm system and control operations of devices included in the alarm system or other household devices (e.g., a thermostat, an appliance, lights, etc.). For example, the controller 212 may be configured to control operation of the network module 214 included in the monitoring system control unit 210.

The network module 214 is a communication device configured to exchange communications over the network 205. The network module 214 may be a wireless communication module configured to exchange wireless communications over the network 205. For example, the network module 214 may be a wireless communication device configured to exchange communications over a wireless data channel and a wireless voice channel. In this example, the network module 214 may transmit alarm data over a wireless data channel and establish a two-way voice communication session over a wireless voice channel. The wireless communication device may include one or more of a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 214 also may be a wired communication module configured to exchange communications over the network 205 using a wired connection. For instance, the network module 214 may be a modem, a network interface card, or another type of network interface device. The network module 214 may be an Ethernet network card configured to enable the monitoring control unit 210 to communicate over a local area network and/or the Internet. The network module 214 also may be a voiceband modem configured to enable the alarm panel to communicate over the telephone lines of Plain Old Telephone Systems (POTS).

The monitoring system may include one or more connected door hinges 222. Each of the one or more connected door hinges 222 may include a wireless communicator chip that allows the door hinge to communicate with the monitor control unit 210. In some implementations, the one or more connected door hinges 222 may communicate with the monitor control unit 210 through Bluetooth, Z-Wave, Wi-Fi, Zigbee, Image Sensor "Bolt" communication protocol, Lora, HomePlug or other Powerline networks that operate over AC wiring. The connected door hinge may look similar to a typical door hinge. The connected door hinge may include a frame side plate and a door side plate that are each the same size and shape of the plates of a standard door hinge. In some implementations, the connected door hinge may include a motor and a telescopic rod that is attached to the door side plate of the hinge, and that extends across to the frame side plate of the door hinge. The telescopic rod may expand and contract to open and close the connected door hinge. In other examples, the door hinge may include a motor and a slotted pin. The motor may move and cause the slotted pin to open and close the door hinge. In other examples, the connected door hinge may include both a telescopic rod along with the motor with a slotted pin. The connected door hinge may include battery power source that powers the door hinge, for example a battery. In some implementations, connected door hinge may be powered by energy created by the opening and closing of the door. The battery and the wireless communicator chip may be located inside a drawer on the frame side plate of the hinge. The connected door hinge may include a status LED at the top of the pin of the hinge.

The monitoring system may include multiple sensors 220. The sensors 220 may include a contact sensor, a motion sensor, a glass break sensor, or any other type of sensor included in an alarm system or security system. The sensors 220 also may include an environmental sensor, such as a temperature sensor, a water sensor, a rain sensor, a wind sensor, a light sensor, a smoke detector, a carbon monoxide detector, an air quality sensor, etc. The sensors 220 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors 220 may include a radio-frequency identification (RFID) sensor that identifies a particular article that includes a pre-assigned RFID tag.

The one or more cameras 230 may be a video/photographic camera or other type of optical sensing device configured to capture images. For instance, the one or more cameras 230 may be configured to capture images of an area within a building monitored by the monitor control unit 210. The one or more cameras 230 may be configured to capture single, static images of the area and also video images of the area in which multiple images of the area are captured at a relatively high frequency (e.g., thirty images per second). The one or more cameras 230 may be controlled based on commands received from the monitor control unit 210.

The one or more cameras 230 may be triggered by several different types of techniques. For instance, a Passive Infra Red (PIR) motion sensor may be built into the one or more cameras 230 and used to trigger the one or more cameras 230 to capture one or more images when motion is detected. The one or more cameras 230 also may include a microwave motion sensor built into the camera and used to trigger the camera to capture one or more images when motion is detected. Each of the one or more cameras 230 may have a "normally open" or "normally closed" digital input that can trigger capture of one or more images when external sensors (e.g., the sensors 220, PIR, door/window, etc.) detect motion or other events. In some implementations, at least one camera 230 receives a command to capture an image when external devices detect motion or another potential alarm event. The camera may receive the command from the controller 212 or directly from one of the sensors 220.

In some examples, the one or more cameras 230 triggers integrated or external illuminators (e.g., Infra Red, Z-wave controlled "white" lights, lights controlled by the module 214, etc.) to improve image quality when the scene is dark. An integrated or separate light sensor may be used to determine if illumination is desired and may result in increased image quality.

The sensors 220, the connected door hinges 222, and the cameras 230 communicate with the controller 212 over communication links 224, 226, and 228. The communication links 224, 226, and 228 may be a wired or wireless data pathway configured to transmit signals from the sensors 220, the door hinges 222, and the cameras 230 to the controller 212. The communication link 224, 226, and 228 228 may include a local network, such as, 802.11 "Wi-Fi" wireless Ethernet (e.g., using low-power Wi-Fi chipsets), Z-Wave, Zigbee, Bluetooth, "HomePlug" or other Powerline networks that operate over AC wiring, and a Category 5 (CAT5) or Category 6 (CAT6) wired Ethernet network.

The monitoring application server 260 is an electronic device configured to provide monitoring services by exchanging electronic communications with the monitor control unit 210, and the one or more user devices 240, over the network 205. For example, the monitoring application server 260 may be configured to monitor events (e.g., alarm events) generated by the monitor control unit 210. In this example, the monitoring application server 260 may exchange electronic communications with the network module 214 included in the monitoring system control unit 210 to receive information regarding events (e.g., alarm events) detected by the monitoring system control unit 210. The monitoring application server 260 also may receive information regarding events (e.g., alarm events) from the one or more user devices 240.

The one or more user devices 240 are devices that host and display user interfaces. The user device 240 may be a cellular phone or a non-cellular locally networked device with a display. The user device 240 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 240 may perform functions unrelated to the monitoring system, such as placing personal telephone calls, playing music, playing video, displaying pictures, browsing the Internet, maintaining an electronic calendar, etc.

The user device 240 includes a native surveillance application 242. The native surveillance application 242 refers to a software/firmware program running on the corresponding mobile device that enables the user interface and features described throughout. The user device 240 may load or install the native surveillance application 242 based on data received over a network or data received from local media. The native surveillance application 242 runs on mobile devices platforms, such as iPhone, iPod touch, Blackberry, Google Android, Windows Mobile, etc. The native surveillance application 242 enables the user device 140 to receive and process image and sensor data from the monitoring system.

The central alarm station server 270 is an electronic device configured to provide alarm monitoring service by exchanging communications with the monitor control unit 210, the one or more user devices 240, and the monitoring application server 260 over the network 205. For example, the central alarm station server 270 may be configured to monitor alarm events generated by the monitoring system control unit 210. In this example, the central alarm station server 270 may exchange communications with the network module 214 included in the monitor control unit 210 to receive information regarding alarm events detected by the monitor control unit 210. The central alarm station server 270 also may receive information regarding alarm events from the one or more user devices 240.

The central alarm station server 270 is connected to multiple terminals 272 and 274. The terminals 272 and 274 may be used by operators to process alarm events. For example, the central alarm station server 270 may route alarm data to the terminals 272 and 274 to enable an operator to process the alarm data. The terminals 272 and 274 may include general-purpose computers (e.g., desktop personal computers, workstations, or laptop computers) that are configured to receive alarm data from a server in the central alarm station server 270 and render a display of information based on the alarm data. For instance, the controller 212 may control the network module 214 to transmit, to the central alarm station server 270, alarm data indicating that a sensor 220 detected a door opening when the monitoring system was armed. The central alarm station server 270 may receive the alarm data and route the alarm data to the terminal 272 for processing by an operator associated with the terminal 272. The terminal 272 may render a display to the operator that includes information associated with the alarm event (e.g., the name of the user of the alarm system, the address of the building the alarm system is monitoring, the type of alarm event, etc.) and the operator may handle the alarm event based on the displayed information.

In some implementations, the terminals 272 and 274 may be mobile devices or devices designed for a specific function. Although FIG. 2 illustrates two terminals for brevity, actual implementations may include more (and, perhaps, many more) terminals.

In some implementations, the one or more user devices 240 communicate with and receive monitoring system data from the monitor control unit 210 using the communication link 238. For instance, the one or more user devices 240 may communicate with the monitor control unit 210 using various local wireless protocols such as Wi-Fi, Bluetooth, Z-Wave, Zigbee, "HomePlug," or other Powerline networks that operate over AC wiring, or Power over Ethernet (POE), or wired protocols such as Ethernet and USB, to connect the one or more user devices 240 to local security and automation equipment. The one or more user devices 240 may connect locally to the monitoring system and its sensors and other devices. The local connection may improve the speed of status and control communications because communicating through the network 205 with a remote server (e.g., the monitoring application server 260) may be significantly slower.

Although the one or more user devices 240 are shown as communicating with the monitor control unit 210, the one or more user devices 240 may communicate directly with the sensors and other devices controlled by the monitor control unit 210. In some implementations, the one or more user devices 240 replace the monitoring system control unit 210 and perform the functions of the monitoring system control unit 210 for local monitoring and long range/offsite communication.

Other arrangements and distribution of processing is possible and contemplated within the present disclosure.

Figure 3:
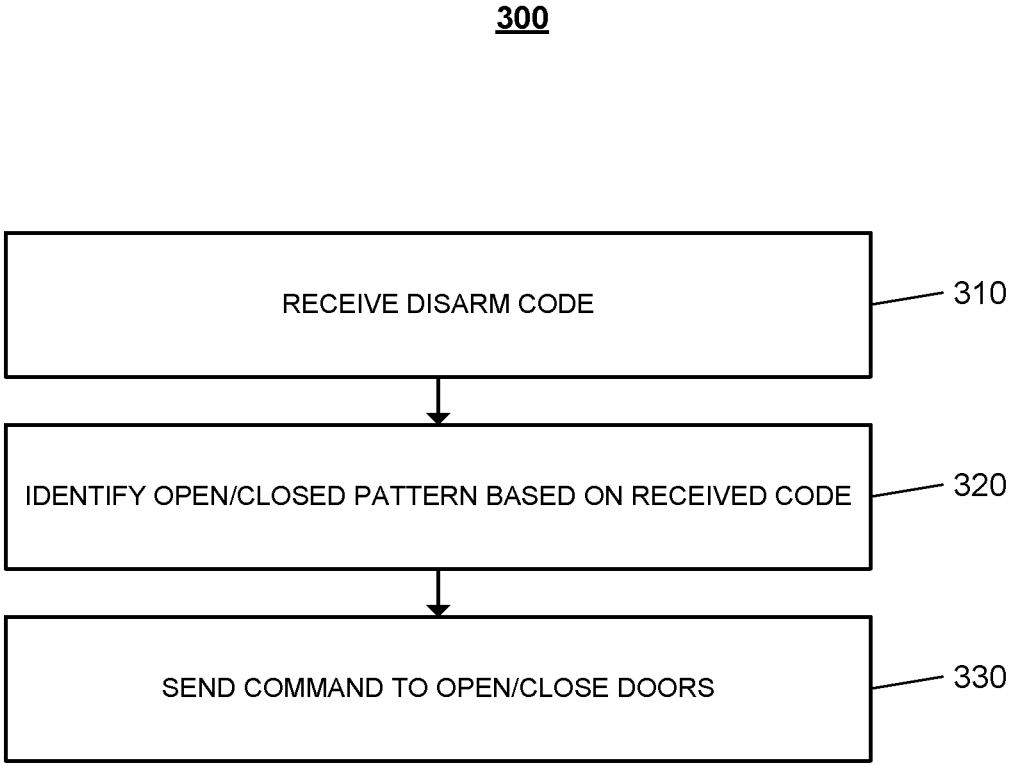
FIG. 3 is a flow chart of an example process for sending commands to open or close doors integrated with connected door hinges.

FIG. 3 illustrates an example process 300 for sending commands to open or close doors with door hinges. The control unit 112 receives a disarm code (310). The control unit 112 includes a user interface that allows a user to manually enter a code to disarm the in-home monitoring system. The user code is a user specific PIN code, or alphanumeric code that is set by a user associated with the monitored property 102. In some examples, the control unit 112 may be configured to receive a voice input of a disarm code from a user 116. In these examples, the user interface of the control unit 112 is configured with a speaker to receive the voice input.

The control unit 112 identifies a door hinge open/close pattern based on the received disarm code (320). A user 116 associated with the monitored property 102 may configure the in-home monitoring system with one or more disarm codes for different users. The user 116 associated with the monitored property 102 may configure the disarm codes for the system by logging into a management account of the in-home monitoring system. During the configuration of the user codes, the user 116 may also configure a door hinge open/close pattern associated with each of the different disarm codes. The door hinge open/close pattern identifies which of the one or more doors with connected door hinges at the monitored property 102 should be opened and which should be closed when the in-home security system is disarmed by a particular disarm code. Each of the configured disarm codes and the associated door hinge open/close pattern are stored in memory at the control unit 112. When a disarm code is entered into the user interface of the control unit 112, the control unit 112 verifies the entered code, and disarms the in-home security system. The control unit 112 simultaneously identifies the door hinge open/close pattern associated with the entered disarm code.

The user 116 associated with the monitored property 102 may configure a single disarm code to be used by each of the members of the family of the monitored property 102. The user 116 may configure this code to close and lock each of the one or more door hinges within the monitored property 102. The user 116 may configure a guest disarm code to be used by someone other than a member of the family at the monitored property 102. The guest disarm code may be a time sensitive disarm code, and may be associated with a door hinge open/close pattern that is different from the door hinge open/close pattern associated with the disarm code used by the members of the family of the monitored property 102. For example, the guest disarm code may be used by a friend/neighbor that visits the monitored property to feed a pet when the family is away, and may be configured to open and unlock only the door of the garage. For another example, the user may configure a technician disarm code which may be a time sensitive code that can be used by technician visiting the monitored property in the absence of the user 116. The technician disarm code may be configured to open only the door to the HVAC room. The control unit 112 may be configured to store several different disarm codes and the associated door hinge open/close patterns. The user 116 may log into the management account to update the disarm codes and the associated door hinge open/close patterns at any time.

The control unit 112 sends commands to open or close one or more of the doors with door hinges based on the identified open/close pattern (330). The control unit 112 identifies the door hinge open/close pattern associated with the entered disarm code and communicates with the one or more door hinges to open or close the one or more doors. In some examples, a connected door hinge may automatically open or close doors with connected door hinges based on a user set schedule. For example, the user 116 may set the door hinge on the entertainment room door to close and lock at 10:00 PM. In some examples, a door hinge may automatically close a door based on the door being open for a set period of time.

Figure 4:
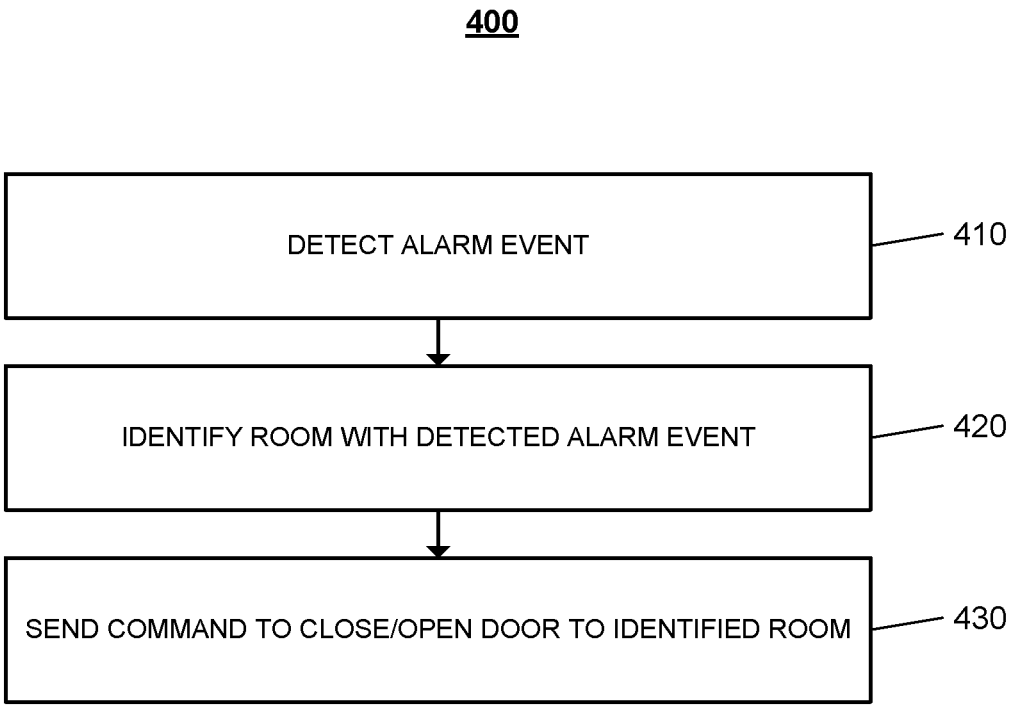
FIG. 4 illustrates an example process for sending an error notification to a user.

FIG. 4 illustrates an example process 400 for sending commands to open or close doors with door hinges based on a detected alarm event. The control unit 112 detects an alarm event (410). The control unit 112 is in communication with one or more different sensors and may detect an alarm event from any of the one or more sensors 104. For example, a fire alarm may detect an alarm condition and communicate the detected alarm condition to the control unit 112, or a contact sensor may detect a window opening on the ground floor of the property and communicate the detected alarm event to the control unit.

The control unit 112 identifies the room with the detected alarm event (420). The data communicated from the sensor that detects an alarm condition may include the room in which the sensor is located, and may also include the identity of the door hinge that controls the opening and closing of the door to the identified room. The control unit 112 detects an alarm event within the monitored property 102 based on receiving alarm condition data from at least one sensor. Based on detecting an alarm event, the control unit 112 may sound an alarm. In some examples, the sensor detecting an alarm condition may sound an alarm. For example, a carbon monoxide sensor may sound an alarm when the detected levels of carbon monoxide exceed a threshold. The control unit 112 at the monitoring property 102 may in-turn communicate the detected alarm event to an external monitoring server 114.

The monitoring server 114 may be a server that is in communication with one or more other in-home monitoring systems. The monitoring server 114 may dispatch emergency personnel to the monitored property based on the detected alarm event. In some examples, the monitoring server 114 may send a notification to the user 116 associated with the monitored property 102 when the emergency personnel are dispatched to the property. In some implementations, the identified room may include one or more cameras 106 that monitor the room. In these implementations, the control unit 112 may receive data from the one or more cameras 106 to verify the alarm condition. For example, a smoke detector may detect smoke in the basement, and one or more cameras 106 may confirm that the basement is on fire.

The control unit 112 sends commands to open/close the door to the identified room (430). The control unit 112 may receive data from the sensor that detected the alarm event and the one or more cameras within the room of the alarm event. Based on the received data, the control unit may command the door to the identified room to open or close. In the example where a sensor detects a break-in in a particular room, the control unit 112 may receive data that identifies a burglary in the room with the break in. Based on the burglar being in the room, the control unit 112 may command the connected door hinge on the door to the room to close and lock. In other examples, where a carbon monoxide sensor detects high levels of carbon monoxide in a particular room, the control unit 112 may receive data from one or more cameras 106, and one or more other sensors 104, and may determine that a person is in the room with the detected high levels of carbon monoxide. The control unit 112 may wait until the person leaves the room to command the door hinge to the room with the carbon monoxide to close and lock the door."

In some implementations, the door hinge open/close pattern may be determined at the time of the detected event by an algorithm. The algorithm may be hosted on the control unit 112 and may determine which of the one or more door hinges that should be closed and locked, and which should be unlocked and opened to minimize the threat of an alarm event. For example, when a fire alarm detects a fire in a particular room of the monitored property 102, the fire alarm communicates the detected event to the control unit 112. The control unit may 112 be configured to determine the location of each of the one or more occupants within the home, and based on the detected location of users within the home, the location of the fire alarm, and the location of the one or more door hinges, may determine an exit route for each of the occupants of the property. The control unit 112 closes and locks all of the door hinges on doors that do not align with the determined exit route, and opens and unlocks the door hinges to doors along the exit routes. In these examples, the LED indicator light on the door hinges light red to visually indicate to the occupants of the house the locked doors, and light green to indicate the unlocked doors. In some implementations, the unlocked door hinges may generate a sound to indicate which doors are unlocked and the locked door hinges may generate a different sound to indicate which door hinges are locked.

Figure 5:
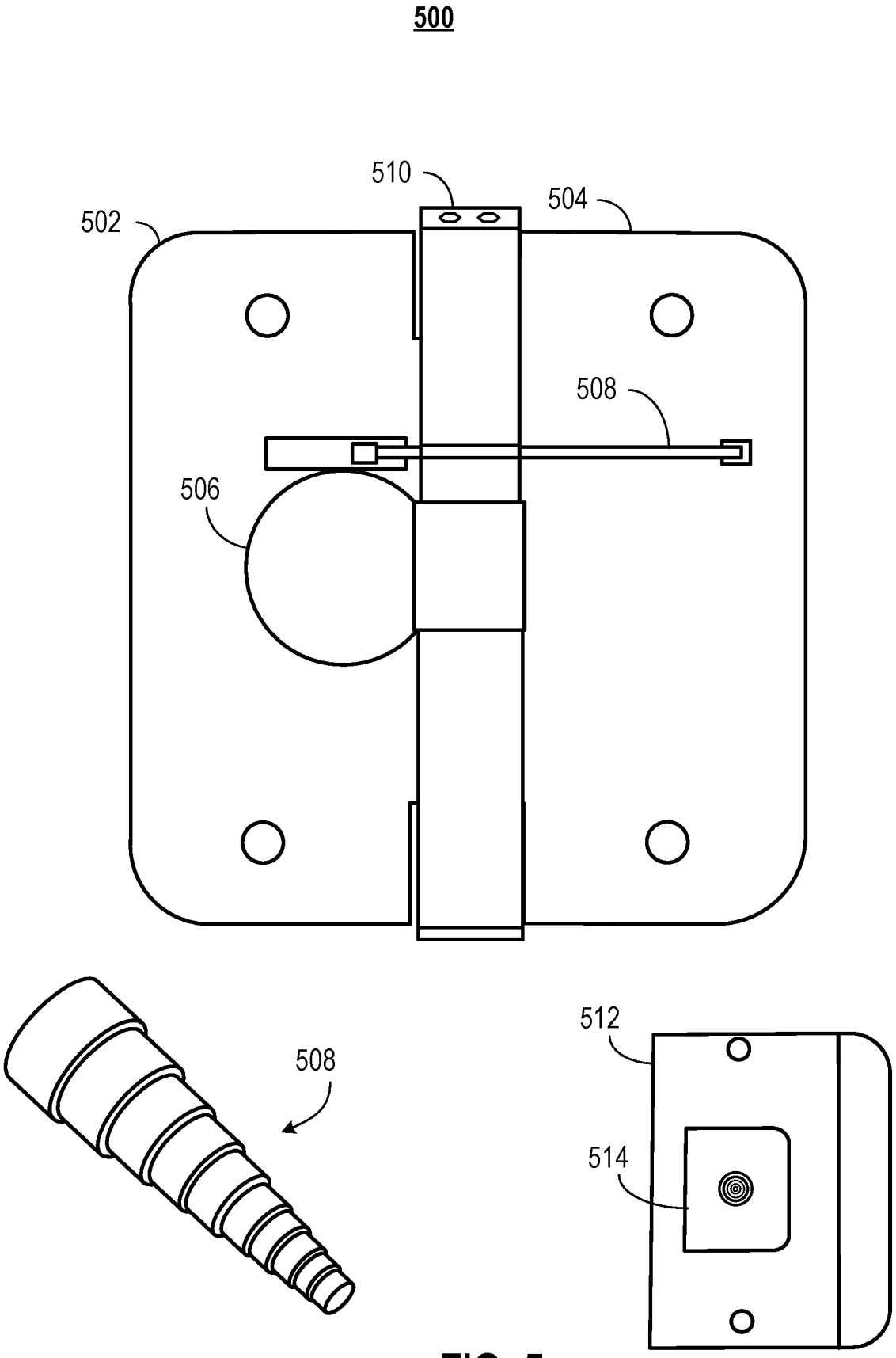
FIGS. 5 and 6 illustrate examples of a connected door hinge.

FIG. 5 illustrates an example of a connected door hinge. The connected door hinge may look similar to a typical door hinge. As illustrated, the door hinge may include a frame side plate 502 and a door side plate 504 that are each the same size and shape of the plates of a standard door hinge. The door hinge may include a motor and a telescopic rod 508 that is attached to the door side plate 504 of the hinge, and that extends across to the frame side plate 502 of the door hinge. The telescopic rod 508 may expand and contract to open and close the door hinge. When the telescopic rod 508 is fully extended, the rod pushes against the frame side plate 502 and causes the hinge to open the door. The door hinge may include a drawer 506 which may be configured to open and close. The drawer 506 may store the wireless communicator and the power source of the door hinge. The door hinge may also include a status indicator LED 510. The door hinge may be coupled with a strike plate 512. The strike plate 512 may be similar in size and shape to a traditional strike plate. The strike plate 512 may include a mechanical telescopic latch rod 514 that is used to unlock the door when the door is in a closed position. The mechanical latch rod 514 is extended to unlock the door and allows the door hinge to then open the door.

In some implementations, the connected door hinge may be connected to a connected door knob. A connected door knob may include a Bluetooth chip that allows the door knob to communicate with the monitor control unit 210. In some implementations, a connected door knob may include chip for other communication protocols such as, Wi-Fi, Z-Wave, Zigbee, "HomePlug," Powerline, etc. The connected door knob may have a similar size and physical appearance of a manual door knob. The connected door knob may include a motor and may be configured to open the door latch.

Figure 6:
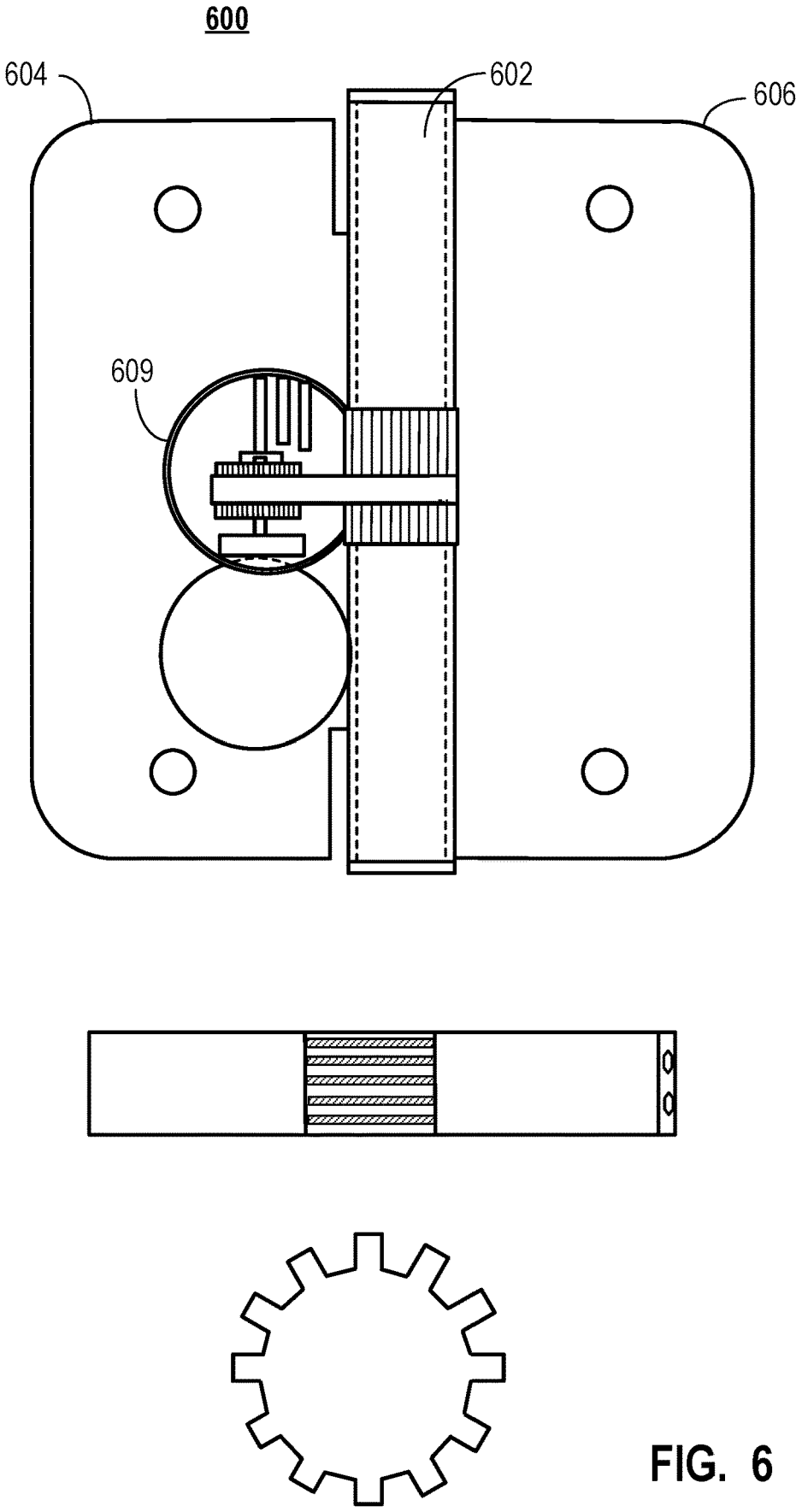

FIG. 6 illustrates an example of a connected door hinge. The connected door hinge may look similar to a typical door hinge. As illustrated, the door hinge may include a frame side plate 604 and a door side plate 606 that are each the same size and shape of the plates of a standard door hinge. The door hinge may include a slotted pin 602. The door hinge may include a drawer 608 that houses the wireless chip communicator and a motor. The motor may engage with the slotted pin 602 which in turn causes the door hinge to open and close.

Figure 7:
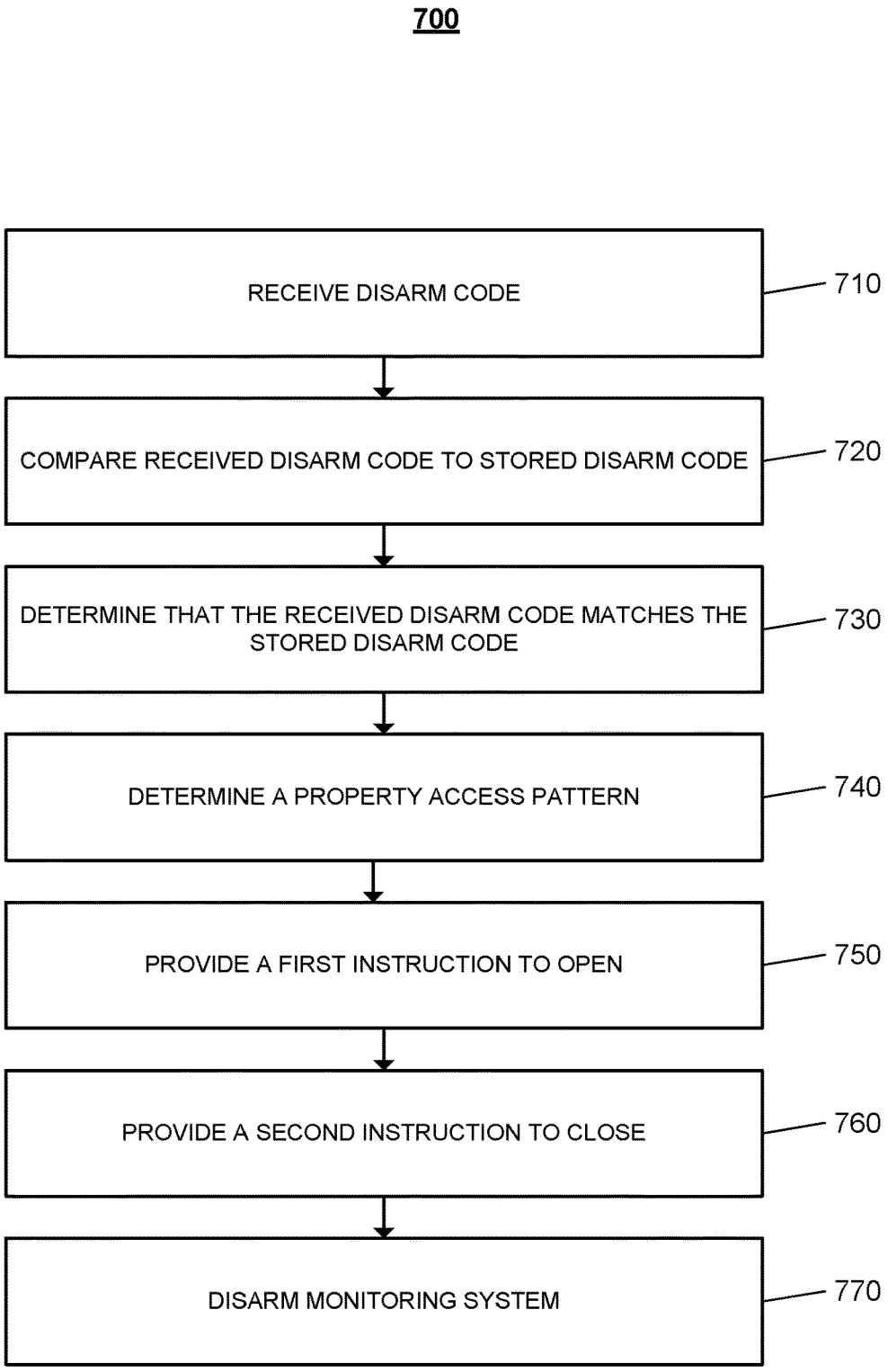
FIG. 7 is a flow chart of an example process for disarming a monitoring system at a monitored property.

FIG. 7 illustrates an example process 700 for disarming a monitoring system at a monitored property. The monitoring system receives a disarm code (710). The monitoring system may be controlled by a monitor control unit at a monitored property. The monitor control unit may include a user interface that allows a user to enter a disarm code to disarm the in-home monitoring system. In other implementations, the user may enter the disarm code into the monitoring application on a user device. The user may be a resident of the monitored property or may be a visitor to the property. The disarm code may be a user specific PIN or alphanumeric code that is configured by an administrative user. The administrative user may be a resident of the property that configures the monitoring system. The administrative user may configure the system through a monitoring system application on their user device or through access to a website for the monitoring system. The monitoring system application may be used to assign a specific connected hinge device open/close pattern to one or more disarm codes that may be used to disarm the monitoring system. The administrative user may assign different disarm codes with a different connected hinge device open/close patterns for each of the one or more residents of the property.

In some examples, the administrative user may set one or more disarm codes for one or more visitors to the property. The user may assign disarm codes that allow different visitors to have access to different areas of the property based on the connected hinge device open/close pattern associated with the assigned disarm code. For example, the administrative user may assign a disarm code for the gardener that opens the door to the garage and the supply room, and closes the door to the living area and bedrooms. In another example, the administrative user may assign a disarm code for a delivery man that opens the front door and closes all the other doors. In yet another example, the administrative user may assign a disarm code for a plumber that opens the door to the garage and the kitchen, and closes and locks the doors to the bedrooms and the living room.

The monitoring system compares the received disarm code to a stored disarm code (720). The monitor control unit may have stored in its memory the one or more disarm codes assigned to the one or more residents and the one or more visitors to the property. When a user enters a disarm code at the user interface of the control panel, the monitor control unit compares the received disarm code to the one or more disarm codes stored in memory. In examples where the user enters the disarm code into the monitoring application on the user device, the monitoring application communicates the disarm code to the monitor control unit to compare to the one or more stored disarm codes. The monitor control unit determines that the received disarm code matches the stored disarm code (730). Based on comparing the received disarm code to the one or more disarm codes stored in its memory, the control unit determines that the received code matches at least one disarm code stored in memory.

The monitoring system determines an access pattern that corresponds to the stored disarm code (740). The monitor control unit identifies the open/close door pattern that matches the disarm code entered by the user. The access pattern identifies a first group of one or more doors inside the property that should be opened, and identifies a second group of one or more doors inside the property that should be closed based on the disarm code entered by the user. In some implementations, the access pattern associated with the disarm code may specify that each of the one or more doors with connected door hinge devices that should be closed should also be locked. For example, the connected door hinge may be configured to close a door and lock the latch on the door when the door is closed. In other implementations, the access pattern that matches the disarm code may specify a subset of the one or more doors that should be closed that should also be locked.

The monitoring system provides a first instruction to open to each of the connected hinge devices on each of the doors of the first group (750). Each of the one or more connected door hinge devices may include a wireless communicator chip that allows the hinge device to communicate with the monitor control unit. For example, the one or more connected hinge devices may communicate with the monitor control unit 210 through Bluetooth, Z-Wave, Wi-Fi, Image Sensor "Bolt" communication protocol, Lora, or other Powerline networks that operate over AC wiring. The monitor control unit communicates with each of the one or more connected hinge devices on each of the doors that should be opened. In examples where a door with a connected hinge device is in a closed position and locked, and the door should be opened based on the disarm code, the connected door hinge device may be configured to unlock the door and move the door to an opened position. In other examples, when a door with a connected hinge device is in an opened position, and the door should be opened based on the disarm code, the connected door hinge device is configured to maintain the door in an opened position.

The monitoring control unit provides a second instruction to close to each of the connected hinge devices on each of the doors of the second group (760). The monitor control unit may communicate with each of the one or more connected hinge devices on each of the doors that should be closed. In examples where the one or more doors that should be closed should also be locked, the monitor control unit commands the connected hinge devices on the doors to be locked. When the monitor control unit commands a connect hinge device to close and lock, the telescopic rod that is attached to the door side plate of the hinge extends to cause the door to close, and the telescopic rod locks into position to cause lock the door. In some implementations, the monitor control unit may generate an error message when a door that should be closed cannot be closed. For example, when an item may be blocking the door from closing, the connected door hinge device on the door communicates the error to the monitor control unit. In these implementations, the monitor control unit may communicate a notification to a user device of a resident of the property indicating that a particular door cannot be closed.

The monitoring system is disarmed (760). The monitor control unit may simultaneously disarm the monitoring system, and provide the instructions to the one or more connected hinge devices on the doors to open and to the one or more connected hinge devices on the doors to close. In some implementations, the monitor control unit firstly provides the first instruction to open the one or more doors, provides the second instruction to the one or more doors, and then disarms the monitoring system.

In some implementations, each of the one or more armed statuses of the monitoring system at the property has a specific associated access pattern. The administrative user may assign a property access pattern that identifies one or more doors that should be opened, and one or more doors that should be closed based on the current arming status at the property. For example, the administrative user may configure the system to close each of the one or more interior doors when the monitoring system is armed away. The user may also wish to lock each of the one or more interior doors when the monitoring system is armed away. In another example, where the monitored property is a two story home, the administrative user may configure the system to close and lock each of the interior doors on the entry level of the home. When the monitor control unit receives a request from a user to arm the monitoring system to armed away, the control unit determines the access pattern associated with the armed away status, and provides instructions to the connected hinge devices on the doors to open and or close the one or more doors.

In some implementations, the monitoring control unit determines an access pattern based on a detected alarm event at the monitored property. In these implementations, the monitoring control unit receives sensor data from one or more sensors located throughout the monitored property. The monitor control unit determines the room of the property with an alarm event, based on the sensor data received. For example, the control unit may receive sensor data from a contact sensor at a window in a bedroom of the property. The monitor control unit commands the connected hinge device on the door to the bedroom of the property with the contact sensor to close and to lock. In some implementations, where the monitored property is a multi-level property, and where a contact sensor detects a breach in the contact sensor in a room on the first floor of the property, the monitor control unit commands each of the connected hinge devices on the doors to the rooms on the first floor of the property to be closed. In some implementations, the monitor control unit may command an LED on the connected hinge device of the door to the room with the breached contact sensor to light red. The monitor control unit may command the LED on the connected hinge device on the door to room with the breached contact sensor to flash red.

In some examples, the monitor control unit may receive sensor data from a carbon monoxide sensor. The sensor data received from the carbon monoxide sensor may indicate that the carbon monoxide levels in a room in the property has exceeded an acceptable level. The monitoring control unit may determine the room of the property with the carbon monoxide levels that exceed the acceptable carbon monoxide levels. The monitoring control unit may prompt one or more cameras in the room with the high carbon monoxide levels to capture image data. The monitor control unit may determine the occupancy based on the image data received from the one or more cameras. In some examples, the monitoring control unit may receive occupancy data from a motion sensor in the room with the high carbon monoxide levels, and may prompt the one or more cameras to capture image data in response to detecting the room is occupied.

When the monitor control unit determines the room with the high carbon monoxide levels is occupied, the monitor control unit may command the connected hinge device on the door of the room to output a command, from a speaker included on the connected hinge device, instructing the occupants to leave the room. In some examples, the monitor control unit may command a speaker device in the room with the high carbon monoxide levels to output the command instructing the occupants to leave the room. Based on the received image data, the monitoring control unit confirms when the room with the high carbon monoxide levels is vacant, and may then provide the connected hinge device on the door to the room with the high carbon monoxide levels to close. In some implementations, when a room with a detected alarm event has more than one door, the monitor control unit commands the connected hinge devices on each of the doors to the room to close.

In some implementations, the monitor control unit may automatically open and or close doors at the property based on a user set timing schedule. The administrative user may set one or more connected hinge devices on a timing schedule through the monitoring system application on the user's device. For example, the user may set a schedule to close the door to the entertainment room at 9:00 PM on a week night. For another example, the user may set a schedule to open the door to a kid's bedroom at 6:00 AM each week day. The monitor control unit may automatically close a door that has been opened for a predetermined period of time. In some examples, the monitor control unit may automatically open a door that has been closed for a predetermined period of time. For example, the user may set a schedule to close the door to the bathroom when the door has been opened longer than sixty seconds.

In some implementations, the connected hinge devices may be configured to be manually opened by a user. In these implementations, the user may tap a hinge pin to manually unlock a connected hinge. In these implementations, when the user taps on the hinge pin, the telescopic rod retracts to unlock and open the connected door hinge. For example, a user may be locked out of a bathroom, and may tap on the hinge pin of the connected hinge device on the door to the bathroom to manually unlock the door.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially-designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

The invention claimed is:

1. A monitoring system that is configured to monitor a property, the monitoring system comprising:

a sensor that is configured to generate sensor data that reflects an attribute of the property;

a first door hinge that is configured to open and close a first door of the property;

a second door hinge that is configured to open and close a second door of the property;

a monitor control unit that is configured to:

receive the sensor data;

based on the sensor data, determine that an event has occurred at the property;

based on the event that has occurred at the property, determine to open the first door and close the second door;

provide, to the first door hinge, an instruction to open the first door;

provide, to the second door hinge, an instruction to close the second door;

receive, from the second door hinge, data indicating that the second door hinge is unable to close the second door;

based on receiving data indicating that the second door hinge is unable to close the second door, generate a notification indicating that the second door is unable to close; and provide, for output, the notification indicating that the second door is unable to close.

2. The system of claim 1, wherein the monitor control unit is configured to:

determine an arming status of the monitoring system, wherein determining to open the first door and close the second door is based on the arming status of the monitoring system.

3. The system of claim 1, wherein the monitor control unit is configured to:

determine that the first door is closed and that the second door is open, wherein determining to open the first door and close the second door is based on the first door being closed and the second door being open.

4. The system of claim 1, wherein the monitor control unit is configured to:

determine that a person is located in a first room associated with the first door; and determine that the event is located in a second room associated with the second door, wherein determining to open the first door and close the second door is based on determining that a person is located in the first room associated with the first door and determining that the event is located in the second room associated with the second door.

5. The system of claim 1, comprising:

a third door hinge that is configured to open and close a third door of the property; and a fourth door hinge that is configured to open and close a fourth door of the property, wherein the monitor control unit is configured to:

receive a security code;

based on the security code, determine to open the third door and close the fourth door;

provide, to the third door hinge, an instruction to open the third door; and provide, to the fourth door hinge, an instruction to close the fourth door.

6. The system of claim 5, wherein the monitor control unit is configured to:

compare the security code to multiple stored security codes; and determine that the security code matches a particular stored security code of the stored security code, wherein determining to open the third door and close the fourth door is based on determining that the security code matches a particular stored security code of the stored security code.

7. The system of claim 6, wherein each of the multiple stored security codes corresponds to a different subset of doors being opened and closed.

8. The system of claim 1, wherein the first door hinge and the second door hinge each include a telescoping rod that is configured to close a respective door by extending.

9. The system of claim 1, wherein the first door hinge and the second door hinge each include a motor and gear box that is configured to open and close a respective door.

10. A computer-implemented method comprising:

receiving, by a monitoring system that is configured to monitor a property, sensor data that reflects an attribute of the property;

based on the sensor data, determining, by the monitoring system that an event has occurred at the property;

based on the event that has occurred at the property, determining, by the monitoring system, to open a first door of the property and close a second door of the property;

providing, by the monitoring system and to a first door hinge that is configured to open and close the first door, an instruction to open the first door;

providing, by the monitoring system and to a second door hinge that is configured to open and close the second door, an instruction to close the second door;

receiving, by the monitoring system and from the second door hinge, data indicating that the second door hinge is unable to close the second door;

based on receiving data indicating that the second door hinge is unable to close the second door, generating by the monitoring system, a notification indicating that the second door is unable to close; and provide, for output by the monitoring system, the notification indicating that the second door is unable to close.

11. The method of claim 10, comprising:

determining, by the monitoring system, an arming status of the monitoring system, wherein determining to open the first door and close the second door is based on the arming status of the monitoring system.

12. The method of claim 10, comprising:

determining, by the monitoring system, that the first door is closed and that the second door is open, wherein determining to open the first door and close the second door is based on the first door being closed and the second door being open.

13. The method of claim 10, comprising:

determining, by the monitoring system, that a person is located in a first room associated with the first door; and determining, by the monitoring system, that the event is located in a second room associated with the second door, wherein determining to open the first door and close the second door is based on determining that a person is located in the first room associated with the first door and determining that the event is located in the second room associated with the second door.

14. The method of claim 10, comprising:

receiving, by the monitoring system, a security code;

based on the security code, determining, by the monitoring system, to open a third door of the property and close a fourth door of the property;

providing, by the monitoring system and to a third door hinge that is configured to open and close the third door, an instruction to open the third door; and providing, by the monitoring system and to a fourth door hinge that is configured to open and close the fourth door, an instruction to close the fourth door.

15. The method of claim 14, comprising:

comparing, by the monitoring system, the security code to multiple stored security codes; and determining, by the monitoring system, that the security code matches a particular stored security code of the stored security code, wherein determining to open the third door and close the fourth door is based on determining that the security code matches a particular stored security code of the stored security code.

16. The method of claim 15, wherein each of the multiple stored security codes corresponds to a different subset of doors being opened and closed.

17. The method of claim 10, wherein the first door hinge and the second door hinge each include a telescoping rod that is configured to close a respective door by extending.

18. The method of claim 10, wherein the first door hinge and the second door hinge each include a motor and gear box that is configured to open and close a respective door.

* * * * *